US005655240A

United States Patent [19]

Miller

[11] Patent Number: 5,655,240

[45] Date of Patent: Aug. 12, 1997

[54] MATTRESS WITH REINFORCING WIRE TRUSS OR STRAP

[75] Inventor: John E. Miller, Tupelo, Miss.

[73] Assignee: Parma Corporation, Denton, N.C.

[21] Appl. No.: 641,806

[22] Filed: May 2, 1996

Related U.S. Application Data

[62] Division of Ser. No. 344,894, Nov. 25, 1994, Pat. No. 5,539,944.

[51] Int. Cl.[6] ..... A47C 23/34; A47C 27/04

[52] U.S. Cl. ..... 5/717; 5/739

[58] Field of Search ..... 5/717, 716, 719, 5/721, 728, 739

[56] References Cited

U.S. PATENT DOCUMENTS

| | | | |
|---|---|---|---|
| 457,041 | 8/1891 | Bonnel et al. | 5/269 |
| 2,159,535 | 5/1939 | Schulman | 5/717 |
| 2,248,093 | 7/1941 | Kronheim et al. | 5/410 |
| 3,284,811 | 11/1966 | Rogers | 5/13 |
| 3,289,224 | 12/1966 | Witchel . | |
| 3,327,331 | 6/1967 | Simon . | |
| 3,516,096 | 6/1970 | Mikos | 5/13 |
| 3,618,146 | 11/1971 | Ferdinand | 5/717 |
| 3,934,281 | 1/1976 | Brindisi | 5/13 |
| 4,004,305 | 1/1977 | Rubin . | |
| 4,104,745 | 8/1978 | Pacitti | 5/13 |
| 4,180,877 | 1/1980 | Higgins | 5/721 |
| 4,200,941 | 5/1980 | Gill et al. | 5/13 |
| 4,253,205 | 3/1981 | Mikos | 5/13 |
| 4,324,011 | 4/1982 | Cavaler | 5/248 |
| 4,381,570 | 5/1983 | Schneider | 5/13 |
| 4,398,311 | 8/1983 | Spitz | 5/13 |
| 4,476,595 | 10/1984 | Ikeda . | |
| 4,489,450 | 12/1984 | Miller | 5/250 |
| 4,571,755 | 2/1986 | Stevens | 5/13 |
| 4,620,336 | 11/1986 | Miller | 5/249 |
| 4,654,905 | 4/1987 | Miller | 5/249 |
| 4,669,134 | 6/1987 | Mikos | 5/13 |
| 4,694,515 | 9/1987 | Rogers, Jr. | 5/13 |
| 4,768,253 | 9/1988 | Boyd et al. . | |
| 4,780,918 | 11/1988 | Hartline | 5/13 |
| 4,811,932 | 3/1989 | Miller | 267/95 |
| 4,850,065 | 7/1989 | Swiderski et al. | 5/13 |
| 4,905,328 | 3/1990 | Pokorny | 5/13 |
| 4,918,770 | 4/1990 | Hartline et al. | 5/13 |
| 4,928,331 | 5/1990 | Arft | 5/13 |
| 4,985,945 | 1/1991 | Robinson | 5/13 |
| 5,184,809 | 2/1993 | Miller | 267/80 |
| 5,257,424 | 11/1993 | Rogers | 5/13 |

OTHER PUBLICATIONS

Summary of Contents of Miller Video, and Video Tape.

*Primary Examiner*—Alexander Grosz

*Attorney, Agent, or Firm*—Bell, Seltzer, Park & Gibson, P.A.

[57] ABSTRACT

A foldable bed is movable between an unfolded position, in which interconnected seat, cavity, and body sections are substantially horizontally aligned and of substantially uniform depth, and a folded position, in which the body section is horizontally disposed, the seat section is horizontally disposed and overlies said body section, the cavity section is generally upright and extends between the body and seat sections. In the folded position, the seat section of the mattress is collapsible, and the cavity section of the mattress is noncollapsible. The bed frame can include a leg that is spaced away from the frame in the folded position that compresses a mattress head section, thereby forming a space within which collapsible springs of the seat section can reside. The bed can include springs having upper, intermediate, and lower runs, wherein the upper and lower runs include offset portions extending in opposite directions that are generally orthogonal to a plane defined by the spring intermediate run. The bed can also include grid wires to which such springs are interconnected that have rotation-limiting means that interact with the offset portions of the spring. Also disclosed is a mattress which is configured with a reinforcing structure having differential rigidity so as to resist force in the horizontal direction but compliantly yield in the vertical direction.

6 Claims, 6 Drawing Sheets

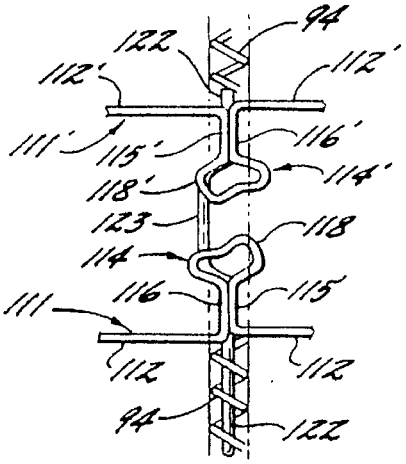
Fig. 9.
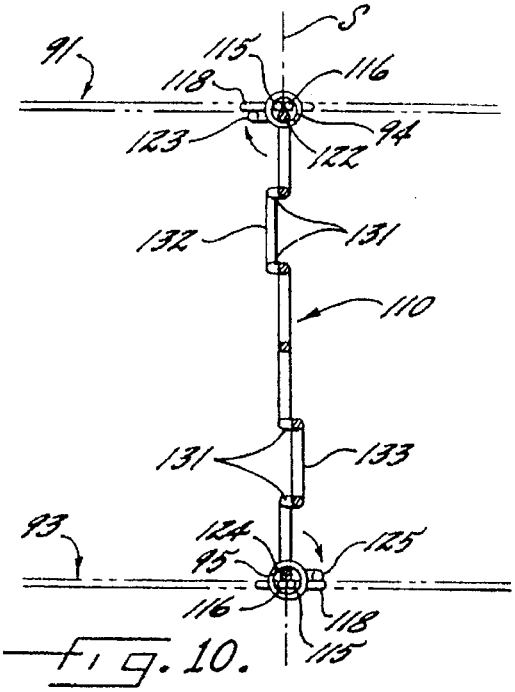
Fig. 10.
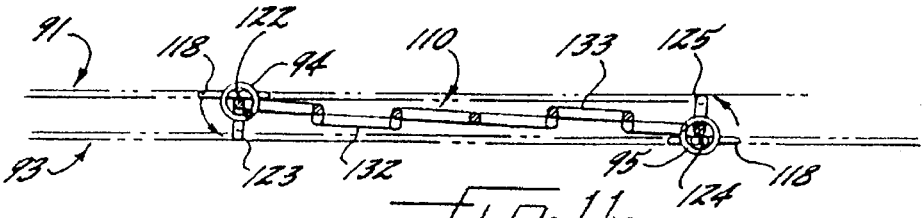
Fig. 11.
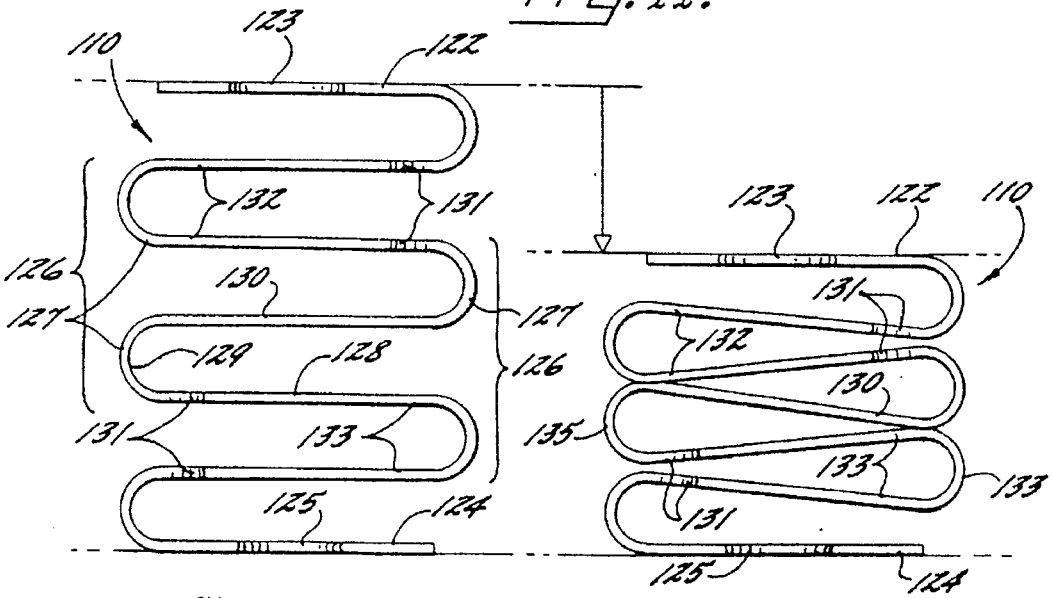
Fig. 12A.
Fig. 12B.

MATTRESS WITH REINFORCING WIRE TRUSS OR STRAP

This application is a divisional of application Ser. No. 08/344,894, filed 25 Nov. 1994, now U.S. Pat. No. 5,539, 944.

FIELD OF THE INVENTION

The present invention relates generally to motion furniture, and relates more particularly to a foldable bed that can be stored within a chair or sofa.

BACKGROUND OF THE INVENTION

Foldable beds, and particularly those folding beds which are stored within other furniture items, are an attractive bedding option for consumers with restricted living space. Typically a foldable bed folds upon itself either one or two times for easy storage, then unfolds into a bed for sleeping. The bed generally includes a mattress that is sufficiently flexible to fold upon itself and a frame which serves as both the supporting bed frame and a restraining unit for the mattress in its folded position. The frame includes a body section pivotally attached at one end to the end of an intermediate cavity section, the opposite end of which is attached to a seal section; these sections are serially aligned horizontally in the unfolded position, and are folded back upon one another such that the body section and seat section are substantially parallel to one another and are perpendicular to the cavity section. The frame is often mounted in an upholstered sofa or chair frame into which the bed frame and mattress are folded and stored when not in use. Cushions are then placed upon the folded mattress for use of the unit as a sofa or chair.

To date, foldable beds have exhibited a number of shortcomings. One general area of dissatisfaction is the sleeping comfort of the bed. For storage purposes, it is desirable that the mattress fold into the thinnest package possible. The need for a compactly folded mattress is particularly important if the mattress and frame are attached to a sofa or chair, since the mattress and frame must fit within the walls of the sofa or chair, which likely has style or ergonomic restrictions. Thick, firm mattresses that would provide suitable sleeping comfort are too bulky to be folded into the space available in many sofa or chair styles; in particular, transitional and contemporary styles often have either a low seat height or an "off-the-floor" front profile and thereby have limited space available in which to store a bed. Present sofas have addressed the size constraint by employing a mattress that is either thin and easily folded into a thin unit, soft and easily crushed, or a combination of each. The result of such compromises is often an unsatisfactory sleeping surface.

Attempts have been made to address the aforementioned problem. One solution has been the development of "collapsible" springs that comprise some or all of the supporting springs in the mattress. These springs are generally planar and are pivotally interconnected at each end to a pair of wire grids that are adjacent and parallel with the upper and lower upholstery faces of the mattress. The springs are oriented to be parallel with the head and foot end faces of the mattress and orthogonal to the upper, lower, and lateral faces of the mattress. When the bed is in its unfolded position, the springs are upright. However, as the bed moves to its folded position, the springs pivot about the wires comprising the grid so that the mattress Lapper surface is drawn closer and shifts longitudinally relative to the mattress lower surface. As a result, the distance between the upper and lower mattress surfaces (i.e., the thickness of the mattress) is significantly decreased, thereby giving the mattress the appearance of having "collapsed". Examples of collapsible springs suitable for use in foldable bedding are illustrated in U.S. Pat. Nos. 4,489,450, 4,620,336, 4,654,905, and 5,184, 809 to Miller and U.S. Pat. No. 5,257,424 to Rogers.

One particular shortcoming of beds having collapsible springs has been the expense of production. Their cost has been quite high because, to date, special machinery has been required to produce these springs. This is particularly true for "M-shaped" springs of the type illustrated in, for example, U.S. Pat. No. 4,654,905 to Miller; U.S. Pat. No. 5,184,809 to Miller.

In addition, collapsible springs have encountered difficulty with "over-rotation" when in the upright position. More specifically, the springs have a tendency to rotate beyond their upright position, particularly if the mattress is under a compressive load. Unless such rotation is halted by somehow constraining the entire mattress section to another mattress section or to the bed frame, the mattress upper surface shifts longitudinally relative to the mattress lower surface, thereby causing the mattress thickness to diminish.

Further, because of their generally planar configuration, collapsible springs are often limited in the degree to which they can be compressed. For example, a sinuous spring such as that illustrated in U.S. Pat. No. 4,654,905 to Miller can compress within its plane only until adjacent undulations contact one another. This problem is not present in coiled springs, as their general shape precludes contact between adjacent coils due to compression until the spring is compressed to a far greater degree than a typical occupant would induce. Limited compression of collapsible springs can render them less comfortable for sleeping; if the occupant is positioned so that a spring is fully compressed, that spring will provide an unforgiving location on the mattress, thus causing the mattress to have inconsistent firmness. In addition, contact between adjacent undulations of sinuous springs under compression can cause a mattress to be somewhat noisy, which, of course, is quite undesirable for a sleeping occupant.

The grid wires comprising the grid to which the springs are attached also present problems. The springs are generally attached to the grid wires either by a clip that encircles the grid wire and spring run, or by a helical wire. For ease of production and for cost reasons, interconnection with a helical wire is preferred; however, previous attempts to interconnect grid wires and spring runs have not been entirely successful; The grid wires, which extend longitudinally (i.e., from head to foot), include perpendicularly-extending finger portions that have at their ends a small loop that extends toward the foot end of the bed. Bed stability improves as the diameter of the helix decreases, so it is desirable to use the smallest possible helix. In many prior embodiments, the helical coil is threaded through the loop in the grid wire. This is a relatively precise task that can be difficult to perform repeatedly with automated equipment. Also, because all of the finger portions extend toward the foot end of the bed, each grid wire must be manufactured separately rather than being able to "double-back" on itself to form the adjacent grid wire. Accordingly, it would be desirable to provide a grid wire configuration that is more conducive to automated assembly with a helical wire and that can be used for multiple adjacent grid wires.

The use of collapsible springs also complicates the folding of the mattress. Because the upper and lower mattress surfaces have shifted relative to one another in the folded position, the mattress length must be reduced in order for the mattress to fold upon itself and fit within the cavity of the seating unit. One approach, illustrated in U.S. Pat. No. 5,257,424 to Rogers, is to add an additional pivoting section to the mattress at the fool: end of the seat section. This approach requires, of course, that the frame and the mechanism controlling the movement thereof have configurations that differ from those used with conventional mattresses.

In view of the foregoing, it is an object of the present invention to provide a foldable bed that includes collapsible springs but that utilizes relatively inexpensive materials and assembly methods.

It is also an object of the present invention to provide a collapsible spring, and in particular a collapsible sinuous spring, that can be compressed to a greater depth than is available for prior art springs.

It is a further object of the present invention to provide a mattress having collapsible springs that do not "over-rotate" from the upright position.

It is an additional object of the present invention to provide a grid wire to be used with collapsible springs that can be easily interconnected therewith with helical wires via automated equipment.

It is another object of the present invention to provide a foldable bed having collapsible springs that can utilize modified conventional bed frame configurations.

It is a further object of the present invention to provide a foldable bed that can be used with a mattress of standard length without major modification of existing bed frames and folding mechanisms.

SUMMARY OF THE INVENTION

These and other objects are satisfied by the present invention, which is directed at a foldable bed and components employed therein. The foldable bed of the present invention, which is movable between a folded position and an unfolded position, comprises a frame that includes a body section, a cavity section, and a seat section, means pivotally interconnecting each of the frame sections for pivotal movement between the unfolded position and the folded position, and a mattress carried by the frame and movable therewith. In the folded position, the body, cavity, and seat sections are serially and horizontally aligned, and in the folded position, the body and seat sections are generally horizontal, the seat section overlies the body section, and the cavity section is substantially upright and between the seat and body sections. The mattress comprises a seat section overlying the frame seat section, a cavity section overlying the frame cavity section, and a body section overlying the frame body section. The mattress is of uniform depth in the unfolded position; in the folded position, the mattress seat section is collapsible in the depth dimension and the body and cavity sections are noncollapsible in the depth dimension. In this configuration, the large majority of the mattress can be formed with less expensive non-collapsible springs, yet the collapsibility of the mattress seat section enables the mattress to fold into a small space. As a result, the mattress depth is sufficient to provide adequate sleeping comfort.

In one embodiment of the present invention, the seat section comprises a skeletal grid frame that includes an upper and a lower set of grid wires, a plurality of wire springs, and first and second pluralities of helical interconnecting wires. The grid wires of the upper and lower sets respectively define substantially parallel upper and lower grid wire planes. Each of the grid wire sets comprises a plurality of grid wires, each of which includes a plurality of runner sections and at least one tongue portion projecting therefrom. Each of the wire springs comprises serially merging upper, intermediate, and lower runs. The intermediate run defines generally a spring plane. Each of the upper and lower runs extend from the intermediate run, with the upper run being substantially parallel with the lower run. The upper run includes an offset portion which defines a first offset plane which is generally orthogonal to the spring plane; the upper run projects in a first direction. The lower run includes an offset portion that defines a second offset plane that is substantially parallel to the first spring plane; the lower run projects in a second direction generally opposite the first direction. The first plurality of helical wires pivotally interconnects the grid wire tongue portions of the upper set of grid wires with the wire spring upper runs, and the second plurality of helical wires pivotally interconnects the grid wire tongue portions of the lower set of grid wires with the wire spring lower runs. The skeletal frame is movable between an erect position, in which the lower grid wire plane is spaced away from the upper grid wire plane and in which the spring plane is substantially orthogonal to the grid wire planes, and a collapsed position, in which the upper and lower grid wire planes are adjacent, and in which the spring plane is nonorthogonal to the grid wire planes. The grid wire tongue portions include rotation limiting means that cooperate with the spring offset portions for halting pivotal movement of the spring relative to the upper and lower grid wire sets as the frame moves to its erect position. This configuration of the wire springs and the grid wires prevents over rotation of the wire springs as they reach the erect position.

In another embodiment, each of the wire springs of the mattress seat section are sinuous and comprise a plurality of undulations formed by alternating interconnected linear and arcuate portions. The wire springs include a section comprising, in serially merging relationship, a first arcuate portion, a first linear portion, an offset portion, a second arcuate portion, a second linear portion, and a third arcuate portion. The offset portion is configured so that the first arcuate and linear portions define a first plane and the second arcuate and linear portions and the third arcuate portion define a second plane substantially parallel to and lateral of the first plane. This configuration enables the first arcuate portion to pass by the third arcuate portion when the spring is compressed, thereby increasing the depth to which a mattress section comprising sinuous springs can be compressed.

In a still another embodiment, the frame of the foldable bed includes a leg pivotally interconnected with the frame that comprises a cross-member extending along the width dimension of the frame and that further comprises a head section pivotally interconnected with the body section. In the folded position, the head section is generally upright. The leg cross-member is configured so that, in the unfolded position, the leg cross-member supports the frame beneath said the section, and in the folded position, the leg cross-member contacts and compresses the mattress head section away from the seat section. This configuration creates additional space within which collapsible springs comprising the mattress seat section can be stored and thus enables a standard-length mattress containing collapsible springs therein to be used with a standard-length frame.

The foldable bed of the present invention also includes a mattress having a top face, an inner core, and a border wire that defines the peripheral edge portion of the top face. Reinforcing means are interconnected with the border wire that permit compression of the top face toward the inner core due to a vertically-directed force, but prevent compression of the top face due to a horizontally-directed force. The reinforcing means is preferably an elongate strap or a stiff wire truss.

BRIEF DESCRIPTION OF THE DRAWINGS

FIG. 9 is a greatly enlarged cross-sectional view taken along lines 9—9 of FIG. 8 showing the interaction between a collapsible spring and its interconnected grid wires when the spring is in its upright position.

FIG. 10 is a greatly enlarged cross-sectional view taken along lines 10—10 of FIG. 8 showing a collapsible spring in its upright position and its interconnecting upper and lower grid wires interacting therewith.

FIG. 11 is a greatly enlarged cross-sectional view of the spring and grid wires of FIG. 10 showing the spring in the collapsed position.

FIG. 12A is a greatly enlarged view of a collapsible spring of the present invention in an uncompressed condition.

FIG. 12B is a greatly enlarged view of a spring as in FIG. 12A showing the spring in a compressed condition.

DETAILED DESCRIPTION OF THE INVENTION

The present invention will now be described more particularly hereinafter with reference to the accompanying drawings, in which present embodiments of the invention are shown. The invention can, however, be embodied in many different forms and should not be limited to the embodiments set forth herein; rather, these embodiments are provided so that this disclosure will be thorough and complete and will fully convey the convey the scope of the invention to those skilled in the art.

The present invention is related to foldable beds and other foldable body supports that can be unfolded into a generally horizontal unfolded position, in which the bed is generally horizontally aligned, with the head end of the bed being nearest the seating unit and the foot end being farthest therefrom, and a folded position within a sofa or other seating unit, in which the bed folds upon itself and is stored within a storage cavity in the seating unit. The locations, positions and movements of certain components of the foldable bed will be described hereinafter by reference to their positions relative to other components of the bed when the bed is in its unfolded position. As used herein, "forward" and derivatives thereof and "front" and derivatives thereof refer to the direction defined by a vector parallel to a surface underlying the bed and seating unit and extending from the foot end of the unfolded bed toward the head end. The term "rear," "rearward," and derivatives thereof refer to the direction opposite the forward direction; i.e., the direction defined by a vector extending parallel to the underlying surface from the bed head end to the bed foot end. Together, the forward and rearward directions form the "longitudinal" directions of the bed. The terms "lateral," "outer," anti derivatives thereof refer to the directions defined by vectors originating at a longitudinal bisecting the bed and extending parallel to the underlying surface and perpendicular to the forward direction. The terms "inward," "inner," "inboard," and derivatives thereof refer to the directions that are opposite the lateral directions; i.e., the directions defined by vectors originating at the lateral edges of the bed and extending toward the aforementioned bisecting plane. Together, the inward and lateral directions form the "transverse" directions of the bed.

Figure 1:
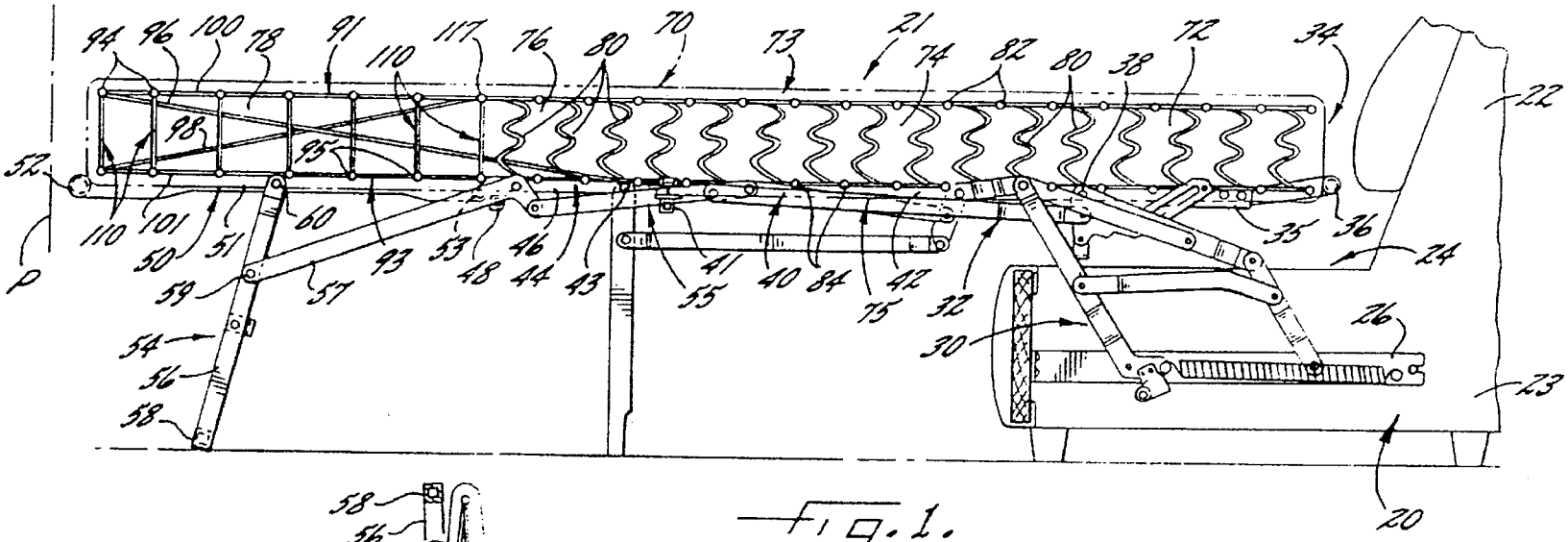
FIG. 1 is a fragmentary side view of a foldable bed of the present invention in its unfolded position.

Referring now to the drawings, FIG. 1 shows a sofa, illustrated broadly at 20, that includes a foldable bed 21. The sofa includes a back rest 22 atop a base 23, the walls of which define a cavity 24 within which the foldable bed 21 is stored in its folded position. Although a sofa is illustrated herein and is preferred, the present invention is suitable for use with other seating units, such as couches, pit-style sofas, love seats, chairs, and the like, within which a foldable bed can be stored.

A pair of mounting rails 26 (only one of which is illustrated herein) are mounted to the inner surfaces of the lateral walls of the base 23. These mounting rails 26 provide a mounting platform for an extension mechanism 30 that controls the retraction and extension of the folded bed 21 into and out of the sofa cavity 24. Except where noted hereinbelow, the individual links comprising the extension mechanism 30 are known to those skilled in this art and need not be described in detail herein. Also, although the extension mechanism 30 illustrated herein is preferred, those skilled in this art will appreciate that any number of extension mechanisms that control the retraction and extension of a folded mattress into and out Of a seating unit can be used with the present invention. Exemplary alternative mechanisms are illustrated in U.S. Pat. No. 5,257,424 to Rogers, the disclosure of which is hereby incorporated herein by reference in its entirety.

Figure 3:
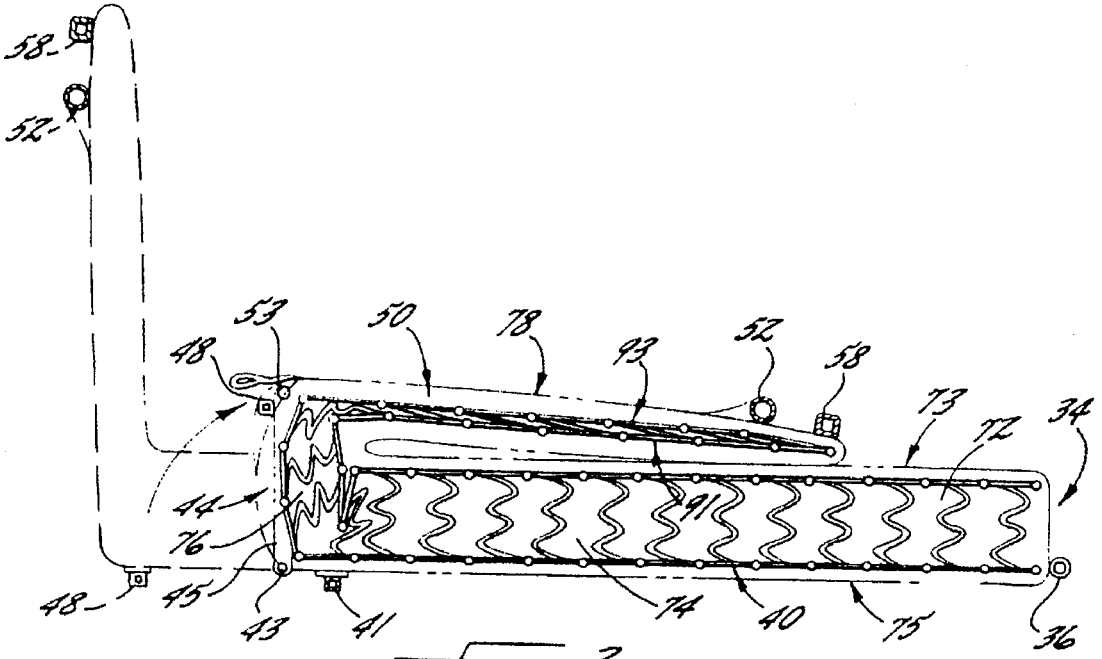
FIG. 3 is a fragmentary side view of the foldable bed of FIG. 1 in an intermediate position in which with the seat section overlies the body section and the cavity section is generally upright.

The foldable bed 21 (FIG. 1) comprises a frame 32 and a mattress 70 which are interconnected and which move in concert with one another. The frame 32 comprises four serially and pivotally interconnected sections: a head section 34, a body section 40, a cavity section 44, and a seat section 50. Each of these frame sections comprises a pair of side rails (only one of which is illustrated herein) having a generally L-shaped profile, each of which supports a respective lateral edge of the mattress 70 from beneath and extends upwardly therefrom to prevent lateral movement of the mattress 70. The bed 21 is movable between an unfolded and generally horizontal position (FIG. 1), in which the head, body, cavity, and seat sections 34, 40, 44, and 50 are serially and horizontally disposed, and a folded position (FIGS. 3 and 4), in which the body and seat sections 40, 50 are generally horizontal, the seat section 50 overlies the body section 40, the cavity section 44 is generally upright, and the head section 34 is disposed generally vertically. The pairs of rails comprising the frame 32 are mirror images of one another about a vertically-disposed plane of symmetry P that bisects the bed longitudinally. As such, only one rail from each frame section will be described herein. Those skilled in this art will appreciate that such description is equally applicable to the mirror image rail on the opposite side of the frame 32.

The rail 35 of the head section 34 (FIG. 1) is pivotally interconnected at its rearward end to the forward end of the body section rail 42 at a pivot 38. In turn, the body section rail 42 is pivotally interconnected at its rearward end to the forward end of the cavity section rail 46 at a pivot 43, and the cavity section rail 46 is pivotally interconnected at its rearward end to the forward end of the seat section rail 51 at a pivot 53. Movement of the frame sections 34, 40, 44, 50 between the unfolded and folded positions is controlled by a folding mechanism 55, which comprises a series of pivotally interconnected links that are interconnected with the frame section rails and with the extension mechanism 30. Those skilled in this art will appreciate that, although the illustrated folding mechanism is preferred, other mechanisms suitable for folding and unfolding mattresses between folded and unfolded positions can also be used with the present invention. Exemplary alternative mechanisms are illustrated in U.S. Pat. No. 4,850,065 to Swiderski et al., U.S. Pat. No. 4,985,945 to Robinson, and U.S. Pat. No. 4,905,328 to Pokorny.

In addition to having a pair of side rails 35, the frame head section 34 further comprises a cross member 36 (FIG. 1) which interconnects the head section rails 35 at their forward ends to define the forward end of the frame 32. Similarly, a cross member 52 extends between the rearward ends of the rails 51 that comprise the frame seat section 50 and thereby defines the rearward end of the frame 32. In addition, a cross member 41 extends between the rails 42 of the body section 40 beneath the mattress 70, and a cross member 45 extends between the rearward ends of rails 46 of the rails of the cavity section 44 beneath the mattress 70. The cross members 41 and 48 provide permanent attachment points for the mattress 70 that prevent longitudinal movement of the mattress 70 relative to the frame 32.

A rear leg 54 (FIG. 1) is pivotally interconnected at a pivot 60 to the central portion of the seat section rails 51 and extends downwardly therefrom in the form of support members 56, each of which is further pivotally interconnected with a bracing link 57 of the folding mechanism 55 at a pivot 59. The pivot 60 that interconnects the rear leg 54 with the seat section rails 51 is positioned rearwardly from its conventional location on the illustrated mechanism 30, and the bracing link 57 is slightly longer than is typically used with the illustrated mechanism 30. As will be described hereinbelow, these modifications compared to a conventional mechanism cause the rear leg 54 to fold advantageously in the folded position. The rear leg 54 includes a cross-member 58 that extends transversely across the width of the bed 21 and that rests on an underlying surface when the bed is in its unfolded position. This configuration enables the leg 54 to provide support for the frame 32 from underneath. Additionally, the leg 54 can serve as the actuating lever for a locking mechanism that retains the bed 21 in the folded position. See, e.g., U.S. Pat. No. 4,985,945 to Robinson and U.S. Pat. No. 4,905,328 to Pokorny.

The mattress 70 (FIG. 1) comprises a head section 72, a body section 74, a cavity section 76, and a seat section 78, each of which overlies and moves in concert with its corresponding frame section into and between the folded and unfolded positions. The mattress 70 includes upper and lower pads 73, 75 which cover the internal coils of the mattress 70. The mattress lower pad 75 overlies a deck (not shown) that spans the space between corresponding side rails and between the head section cross member 36 and the seat section cross member 52. As noted hereinabove, the mattress 70 is fixed to the frame via threaded fasteners (not shown) inserted through the lower pad 75 and the deck and into the cross members 41 and 48. These fixed attachment points prevent the mattress 70 from shifting longitudinally relative to the frame 32, as such shifting can disrupt folding of the mattress 70 and the bed 21.

The mattress head, body, and cavity sections 72, 74, and 76 comprise a plurality of conventional Bonnell-type helical coil springs 80 (FIGS. 1, 5, and 6) which are arranged in an array of transverse rows and longitudinal columns. The springs 80 are oriented so that the longitudinal axis of each helix is generally upright. The uppermost coils of springs 80 in adjacent rows are interconnected by helical wires 82. Similarly, the lowermost coils of springs 80 in adjacent rows are interconnected by helical wires 84. The springs 80 comprising the rearmost row in the cavity section 76 include a flattened portion 86 in the rearmost portions of their upper and lower coils.

Figure 5:
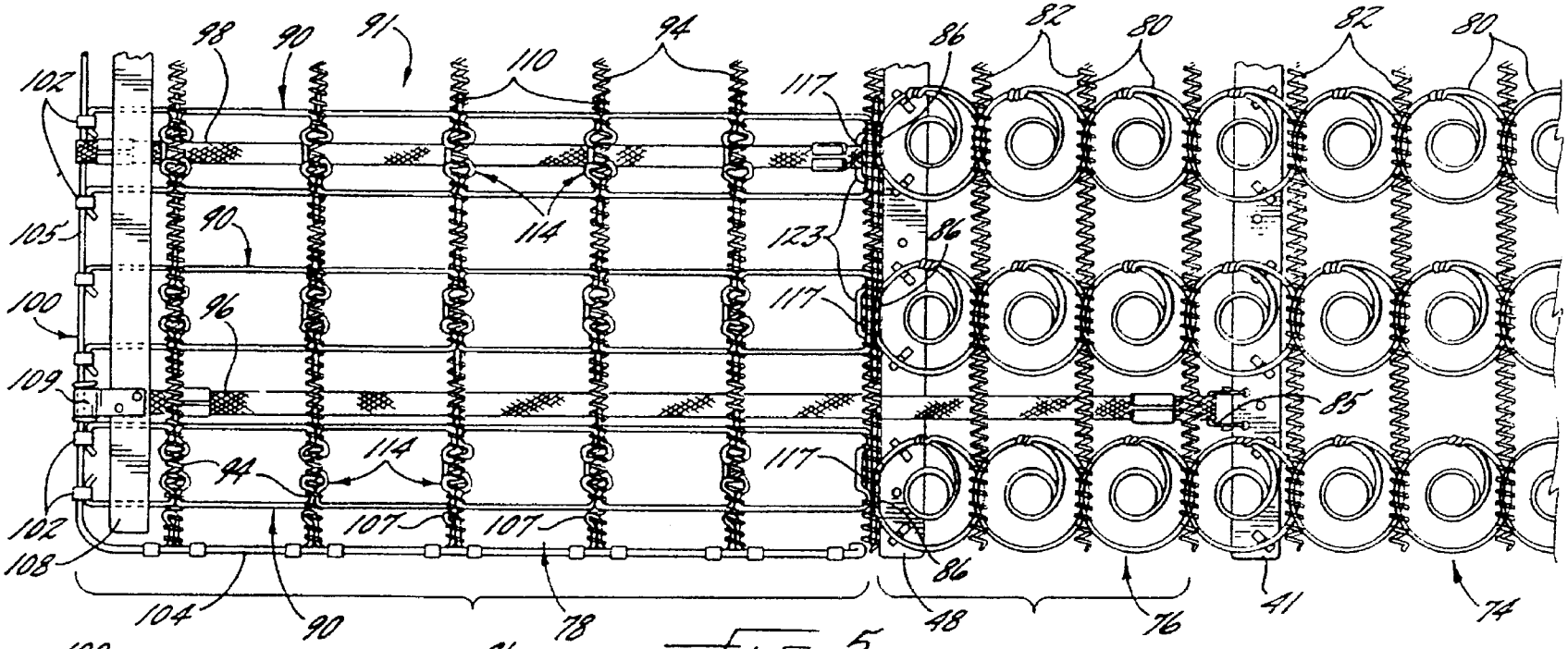
FIG. 5 is an enlarged plan view showing portions of the seat, cavity, and body sections of the mattress with the fabric removed for clarity.
Figure 6:
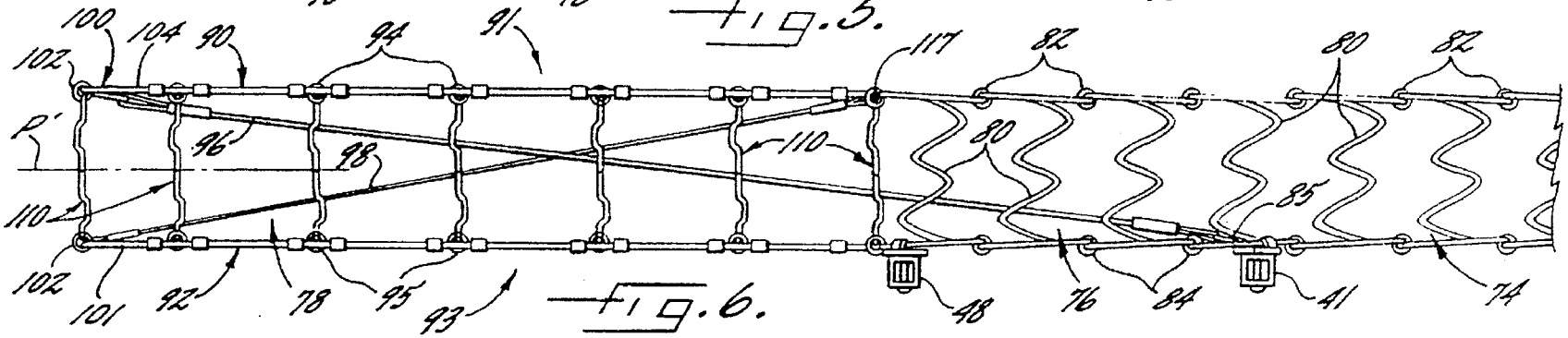
FIG. 6 is a side view of the enlarged portion of the mattress illustrated in FIG. 5 with the fabric removed for clarity.

As can also be seen in FIGS. 5 and 6, the seat section 78 of the mattress 70 comprises a plurality of vertically disposed sinuous collapsible springs 110 arranged in an array of transverse rows and longitudinal columns, a plurality of grid wires 90 that, along with an upper border wire 100, form an upper grid 91, a plurality of lower grid wires 92 that, in conjunction with a lower border wire 101, form a lower grid 93, a plurality of upper helical interconnecting wires 94, and a plurality of lower helical interconnecting wires 95. The upper grid 91 is positioned just beneath the mattress upper pad 73, and the lower grid 93 is positioned just above the mattress lower pad 75.

Each of tire collapsible springs 110 is essentially identical to each of the other collapsible springs 110. Accordingly, for brevity and clarity only one spring 110 will be described in detail herein; those skilled in this art will appreciate that the description is equally applicable to the other springs 110 contained within the seat section 78.

Best seen in FIGS. 7 through 12B, the spring 110 comprises a single length of wire formed into an upper run 122, a lower run 124, and a sinuous intermediate run 126 comprising a series of merging undulations 127 (FIG. 12A). The upper run 122 of the spring 110 includes an upper run offset portion 123 which projects rearwardly. Conversely, the lower run 124 includes an offset portion 125 that projects forwardly therefrom. Preferably, the offset portions 123, 125 extend from their respective runs between about 0.125 and 0.5 inches. The nonoffset portions of the upper and lower runs 122, 124 define a spring plane S (FIG. 10). The undulations 127 of the intermediate run 126 each comprises a linear segment 128, an arcuate portion 129, and a second linear portion 130. The second linear portion 130 also serves as a linear segment for the next merging undulation 127. As illustrated in FIGS. 10 and 12A, each collapsible spring 110 comprises a pair of undulations 132, 133 that are offset from the spring plane S defined generally by the nonoffset portions of the spring 110 due to the inclusion of offset portions 131 located at the origin of these undulations. The offset undulation 132, which is adjacent the spring upper run 122, resides in a plane that is offset rearwardly from the spring plane S. The offset undulation 133, which is adjacent the spring lower run 124, resides in a plane that is offset forwardly from the spring plane S.

Illustratively and preferably, the spring 110 is formed of a single wire strand, but those skilled in this art will appreciate that the spring 110 could be formed of multiple wire strands spliced together. In addition, other collapsible spring configurations, such as those illustrated in U.S. Pat. Nos. 4,654,905 and 5,184,809 to Miller, the disclosures of which are hereby incorporated herein by reference in their entirety, can also be used with the present invention. It is preferred that the spring be formed of wire having a thickness of between about 0.080 and 0.120 inches.

As described above, the upper grid 91 (FIGS. 5 and 6) comprises a plurality of upper grid wires 90 and a border wire 100, and the lower grid 93 comprises the plurality of lower grid wires 92 and the lower border wire 101. The upper grid 91 and the lower grid 93 are mirror images of one another about a plane of symmetry P' (FIG. 6) that bisects the mattress in the depth dimension. Accordingly, only the upper grid 91 will be described herein; those skilled in this art will appreciate that this discussion is equally applicable to the lower grid 93.

The border wire 100 (FIGS. 5 and 6) extends about the lateral and rearward periphery of the seat section 78 in serially merging lateral, rearward, and lateral sections 104, 105 (only one lateral section is illustrated herein). A lateral grid wire 103 that includes a series of one-way loops 107 is attached beneath each of the border wires lateral sections 104 to be essentially coplanar with the upper grid wires 90. Typically, the border wire 100 is formed of a heavy gauge wire strand to provide stability to the mattress 70.

All of the upper grid wires 90 are substantially identical to one another. In the interest of brevity, only one grid wire 90 will be described in detail herein; those skilled in this art will appreciate that this discussion is equally applicable to the other grid wires 90 of the mattress 70.

Each grid wire 90 (FIGS. 7 and 8) comprises a single continuous wire segment originating at a hook 113 that is attached with a clip 102 to the border wire rearward section 105, extends forwardly as a longitudinal section 111 to abut the flattened portion 86 of a Bonnell spring 80 of the mattress cavity section 76 (seen best in FIG. 5), extends transversely as a transverse section 117 along the flattened portion 86, and returns rearwardly as a longitudinal section 111' to terminate in a hook 113' that is attached with a clip 102 to the border wire rearward section 105 adjacent the hook 113. The longitudinal sections 111, 111' of the grid wire 90 each comprise six runner sections 112 which extend substantially parallel with one another and which merge at their ends with five tongue portions 114, each of which extends substantially perpendicularly from its merging runner section 112 toward its opposing longitudinal section 111'. Each of the runner segments 112 is slightly transversely offset from its longitudinally adjacent runner segments 112 to increase the torsional stability of the longitudinal section 111. The tongue portions 114 of the grid wire 90 each comprise a pair of wire segments 115, 116 that extend substantially perpendicularly to the grid wire runner sections 112 and substantially parallel to one another (FIG. 9). These wire segments 115., 116 then separate and form a skewed two-way loop 118. The two-way loop 118, best viewed in FIG. 9, is configured so that it can receive a helical wire 94 irrespective of whether the tongue portion 114 extends laterally or inwardly. The two-way loop 118 also protrudes longitudinally in each direction sufficiently that it contacts the offset portion 123 of the spring upper run 122 whether the tongue portion 114 to which it is attached extends laterally or inwardly. Preferably, the two-way loop 118 protrudes in one longitudinal direction farther than in the other longitudinal direction, and the portion of the two-way loop that protrudes less in the longitudinal direction protrudes farther in the transverse direction. More preferably, the two-way loop 118 is configured so that one portion extends between about 0.25 and 0.5 inches longitudinally, and between about 0.125 and 0.375 inches transversely, from its merging wire segment 115 and so that a second portion extends between about 0.125 and 0.375 inches longitudinally and between about 0.25 and 0.5 inches transversely from its merging wire segment 116. Although the illustrated two-way loop 118 is preferred, those skilled in this art will appreciate that other configurations that halt the rotation of an interconnected collapsible spring are suitable for use with the present invention.

Those skilled in this art will appreciate that the upper and lower grids 91, 93 can be formed of grid wires that extend only forwardly from the border wire rearward section 105 to the cavity section 76 without "doubling-back," and can also be formed to double-back three, four, five, or even more times and still be suitable for use with the present invention. Also, the runner sections 112 and tongue portions 114 need not be formed of a continuous wire strand, but instead can be formed as separate components that are connected in a subsequent step. Preferably, the grid wire 90 is formed of wire having a thickness of between about 0.050 and 0.080 inches, and, in any event, should be formed of wire that is thinner than that comprising the collapsible spring 110.

Figure 7:
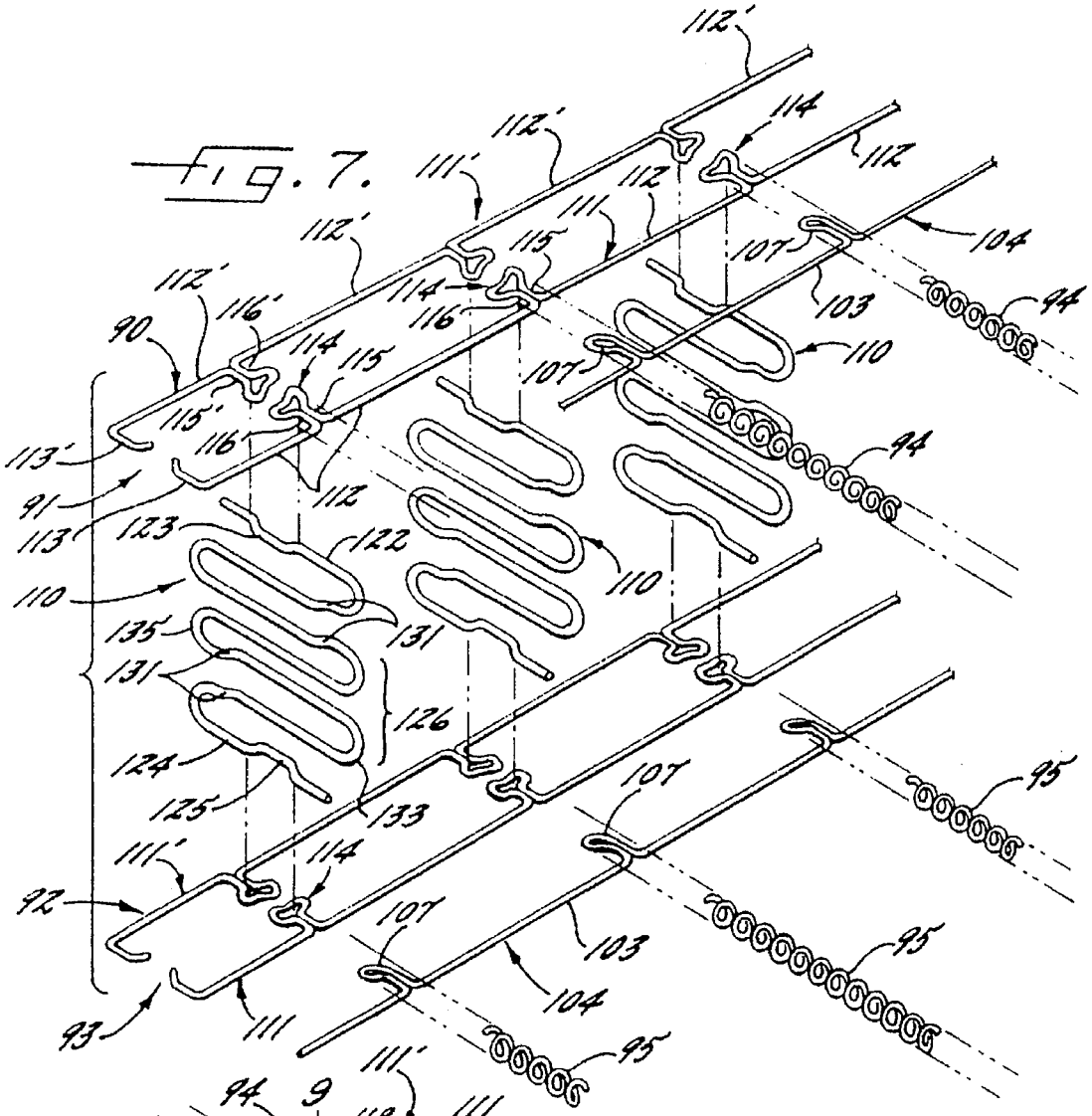
FIG. 7 is an enlarged exploded perspective view showing the interconnection of collapsible springs and grid wires of the present invention.
Figure 8:
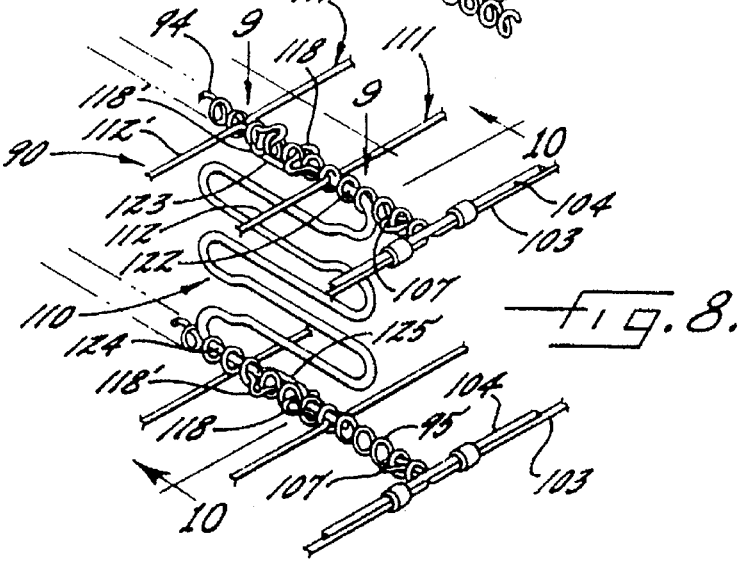
FIG. 8 is an enlarged perspective view showing the components of FIG. 7 in an assembled state.

FIGS. 7 and 8 illustrate the interconnection between the upper and lower grids 91, 93, the collapsible springs 110, and the helical interconnecting wires 94, 95, which together form the seat section 78 of the mattress 70. The upper run 122 of each collapsible spring 110 contacts the wire segments 115, 116 of opposing tongue portions 114 of an upper grid wire 90. The offset portion 123 of the spring upper run 122 contacts the lower surfaces of the two-way loops 118 of opposing tongue portions 114 of the grid wire 90 (FIG. 9). A helical interconnecting wire 94 is then wrapped about the upper run 122 and wire segments 115, 116 of each tongue portion 114 so that the upper run rests within the groove formed by the wire segments 115, 116. In this configuration, these components are interconnected but can pivot relative to one another. As can be seen in FIG. 8, the helical wire 94 encircles the wire segments 115, 116 and the spring upper run 122, proceeds to interpose one coil within the two-way loop 118, and then avoids any interaction with the offset portion 123. The helical wire 94 then proceeds to interpose one coil with the two-way loop 118 and to encircle wire segments 115, 116 of the opposing tongue portion 114. The helical wire 94 terminates at each end by interposition within the one-way loops 107 of the lateral grid wires 103. Although interconnection of the springs 110 and the grid wires 90 with a helical wire 94 is preferred, those skilled in this art will appreciate that other means of interconnecting these components, such as clips similar to clips 102 (which are used to interconnect the grid wires 90 to the border wire 100), are also suitable for use with the present invention. Similarly, the spring lower run 124 contacts the upper surfaces of wire segments 115, 116 of opposing tongue portions of a lower grid wire 91. The offset portion 125 of the spring lower run 124 contacts the two-way loops 118 of opposing tongue portions 114 of a lower grid wire 92. The spring lower run 124 and the tongue portions 114 are pivotally interconnected via a helical interconnecting wire 95.

Notably, the configuration of the two-way loop 118 enables the grid wire 92 to be of the same configuration as that of grid wire 90, thus eliminating the need for the design and manufacture of another component. Also, the configuration of the spring 110 enables it to be oriented so that the lower run 124 becomes the upper run and vice versa.

The seat cavity section 78 (FIGS. 5 and 6) also includes a bowing strap 108 that rests upon its rearmost upper portion; this bowing strap 108 is interconnected with the rearward section 105 of the upper border wire 100 via a series of clips 109 (only one is shown). In addition, the seat section 78 includes a flexible foot-to-body strap 96 that is attached to the upper border wire 100 and extends forwardly to attach to the body section cross member 41 via a buckle 85. Also, a foot-to-cavity strap 98 is attached to the lower border wire 101 and extends forwardly and upwardly to attach to the rearmost portion of the cavity section 76.

Folding of the bed 21 into its folded position begins with the bed 21 in its unfolded position (FIG. 1). In the unfolded position, the rails 35, 42, 46, 51 of the head, body, cavity, and seat sections 34, 40, 44, and 50 are serially aligned and generally horizontally disposed. Accordingly, the corresponding mattress head, body, cavity and seat sections 72, 74, 76 and 78 are serially aligned and disposed horizontally above the frame 32. The collapsible springs 110 of the mattress seat section 78 are disposed in an upright condition, with the offset portions 123 of the spring upper runs 122 extending rearwardly therefrom, and with the offset portions 125 of the spring lower runs 124 extending forwardly therefrom. Each of the offset portions 123 contacts the rearwardly-protruding portions of the two-way loops 118 of opposing tongue portions 114 of the upper grid wires 90; similarly, each of the offset portions 125 contacts the forwardly-protruding portions of the two-way loops 118 of opposing tongue portions of the lower grid wires 92 (FIGS. 9 and 10). The interaction between the offset portions 123, 125 and their respective pairs of two-way loops 118 prevents the spring 110 from rotating so that the upper run 122 moves forwardly relative to the lower run 124; however, the spring 110 is free to move responsive to a folding movement of the frame 32 so that the upper run 122 moves rearwardly relative to the lower run 124. Such movement of the springs is prevented in the unfolded position by the foot-to-body strap 96, which remains taut in this position.

In addition, the bowing strap 108 rests atop the upper grid 91. In this position, the bowing strap 108, which illustratively comprises an elongate metallic strip, provides stiffness and thus stability to the upper border wire rearward section 105 against a forwardly-directed force applied thereto, such as that applied by an occupant leaning on the rear edge of the bed 21. The bowing strap 108 can flex in response to a downwardly-directed force, such as that applied by a seated or prone occupant, and thus does not interfere with sleeping comfort. It should also be noted that bowing straps that are interconnected with the upper border wire lateral sections 104 can also be included to provide stability to the lateral edges of the mattress 70 against inwardly-directed forces.

Figure 13:
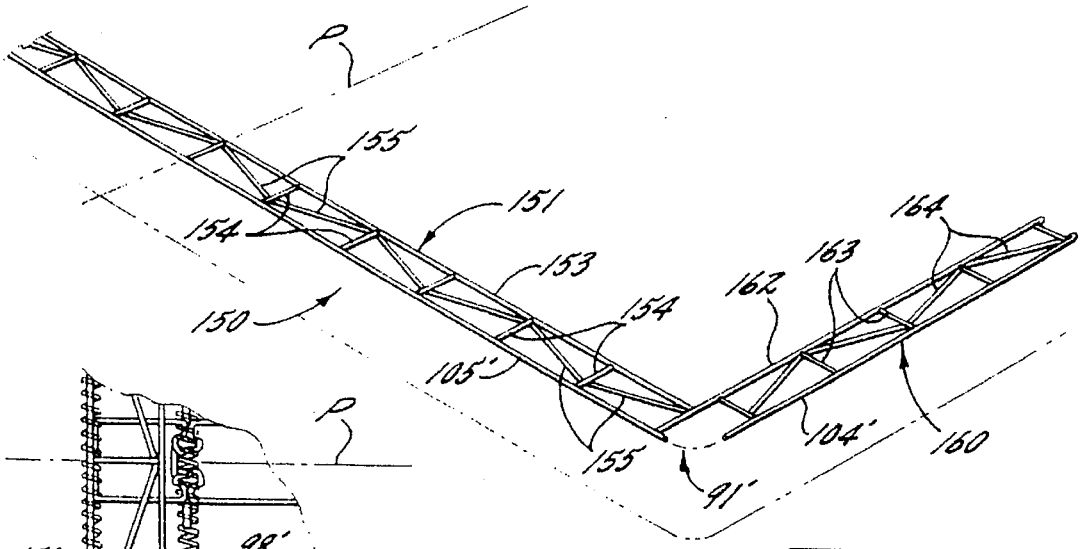
FIG. 13 is a perspective view of a portion of another mattress embodiment of the present invention showing a wire truss on the upper grid of the mattress seat section.
Figure 14:
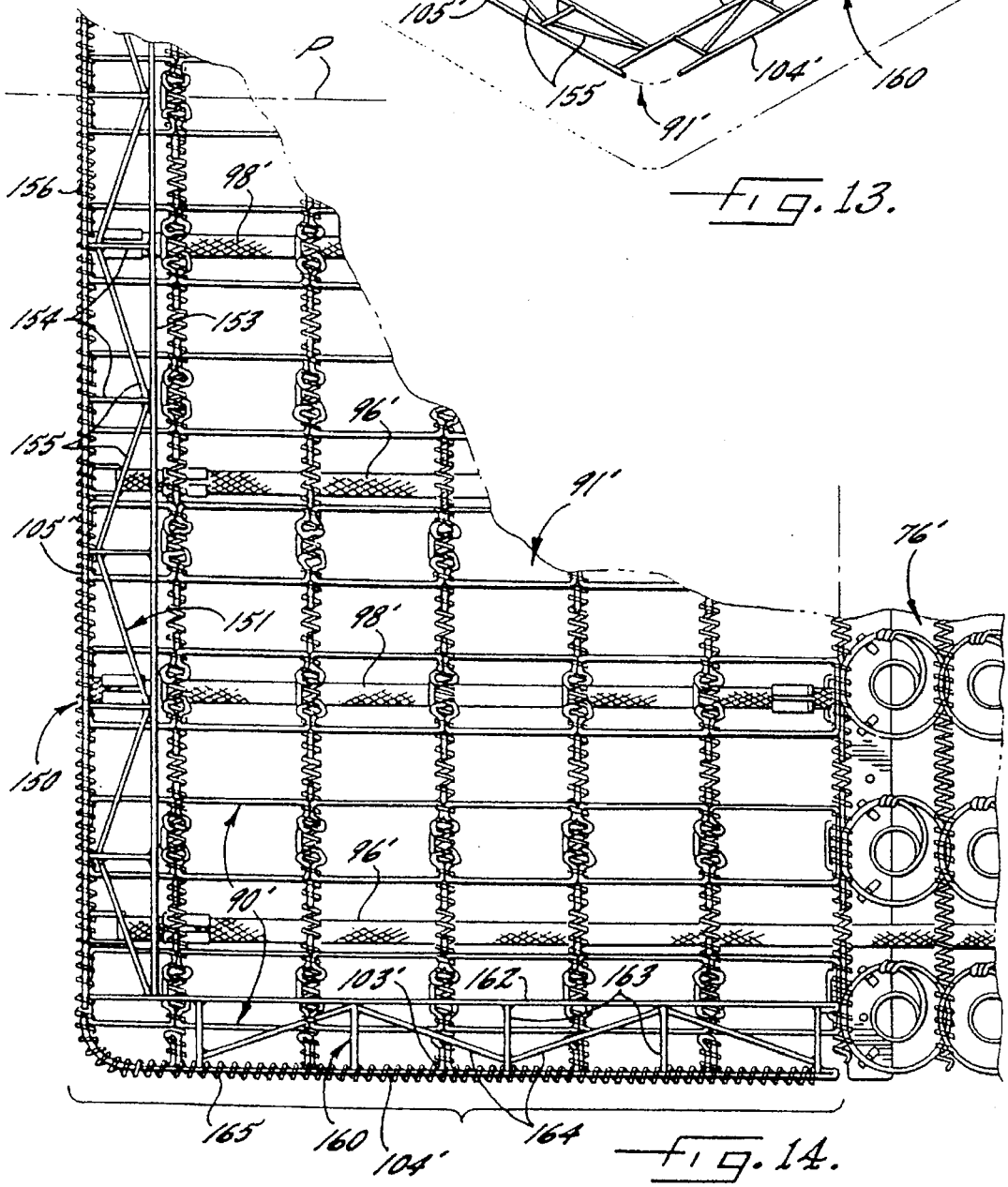
FIG. 14 is an enlarged plan view of the mattress seat and cavity sections with the wire truss as in FIG. 13.

Those skilled in this art will appreciate that, although the bowing strap 108 is preferred, other means for providing stiffness in the forward direction and flexibility in the downward direction can also be used with the present invention. An exemplary alternative to the bowing strap, illustrated in FIGS. 13 and 14, is a stiff wire truss 150 positioned atop the upper grid 91'. The truss 150 comprises a foot section 151 and a pair of lateral sections 160 (only one of which is illustrated herein). The foot section 151 comprises the border wire rear section 105', an inner foot wire 153, a series of longitudinally-extending wire sections 154 extending between the border wire rear section 105' and inner foot wire 153, and a series of triangulated crosswires 155 extending diagonally between opposite longitudinal ends of adjacent wire sections 154. The foot section 151 is interconnected to the upper grid 91' via a helical wire 156, which is illustratively employed to interconnect upper grid wires 90' to the rearward border wire section 105'. The lateral truss section 160 comprises a lateral border wire section 104', an inner wire 162, transverse sections 163, and triangulating sections 164 arranged in a similar configuration to that of the foot section 151 is interconnected. The lateral section inner wire 162 is fixed at its rearward end to the lateral end of the foot section inner wire 153. The lateral section outer wire 161 is interconnected with the upper grid 91' via a helical wire 165 that encircles the lateral grid wires 103'. As described above for the bowing strap 108, the truss foot section 151 resists forward movement of the upper border wire rear section 105' in response to a forwardly directed force, but can itself deflect in response to a downwardly-directed force. Similarly, the truss lateral section 160 resists inward movement of the upper border wire lateral section 104' in response to an inwardly-directed force, but deflects downwardly in response to a downwardly-directed force.

An upwardly directed force is applied to the rear leg cross-member 58 to initiate folding of the bed 21 from its unfolded position (FIG. 1). In response to the ascension of the leg cross-member 58, the frame seat section 50 rotates about the pivot 53 until the bed 21 arrives at an intermediate position (shown in FIG. 2) in which the seat section rails 51 are generally upright. The movement of the frame 32 is controlled by the folding mechanism 55.

Simultaneous with the movement of the frame, the upper grid 91 pivots about a pivot axis positioned within the helical wire 94 that interconnects the transverse sections 117 of the upper grid wires 90 with the flattened portions 86 of the coil springs 80, and the lower grid 93 pivots about a pivot axis positioned within the helical wire 95 that interconnects the transverse sections of the lower grid wires 92 with the flattened portions 86 of the lower coils of the coil springs 80. The remainder of the frame 21 and the mattress 70 remain substantially stable. The upper grid 91 shifts longitudinally relative to the lower grid 93, with the result that the upper grid 91 extends past the frame seat section cross member 52. The foot-to-body strap 96 remains taut in this position.

The action of the collapsible springs 110 and the upper and lower grid wires 90, 92 is best understood by examination of FIGS. 9, 10, and 11. FIG. 10 shows a collapsible spring 110 in its upright position. The spring 110 is prevented from rotating so that its upper run 122 moves forwardly relative to its lower run 124 (in the clockwise direction in FIG. 10) by the contact between the upper and lower offset portions 123, 125 and the two-way loops 118 in the upper and lower grid wires 90, 92. As the bed 21 moves to the intermediate position, the upper grid 91 is forced toward the foot end of the bed 21 relative to the lower grid wires 92; because the upper and lower runs 122, 124 of the spring 110 can pivot within the helical wires 94, 95, the springs move in response to the relative movement of the upper grid 91 to the "collapsed" position illustrated in FIG. 11. The springs 110 remain in this collapsed position as the remainder of the bed 21 is folded into the cavity 24.

Figure 2:
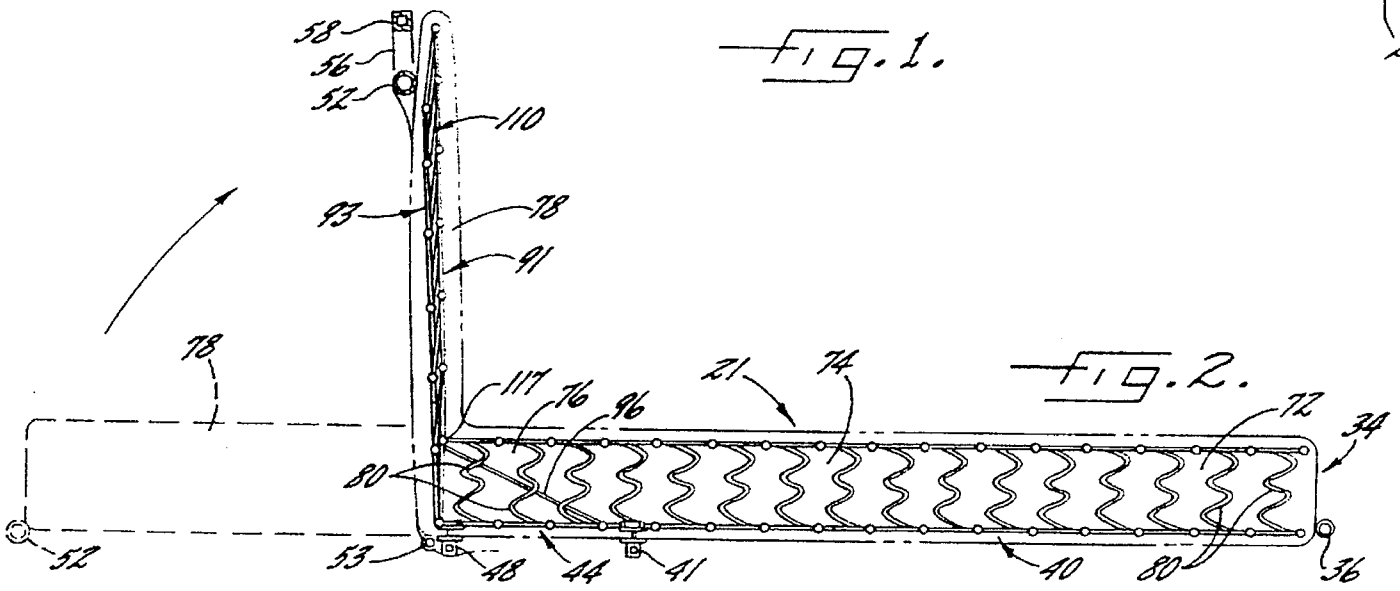
FIG. 2 is a fragmentary side view of the foldable bed of FIG. 1 with the seat section folded to an upright intermediate position.

During the folding of the bed into the intermediate position of FIG. 2, the rear leg 54 pivots relative to the frame seat section 50 so that the support members 56 are generally parallel with the frame seat section rails 51. In this position, the rear leg cross-member 58 is positioned so as to be spaced away from the seat section cross-member 52. Preferably, the rear leg support members 56 are configured and interconnected with the seat section rails 51 so that the cross-member 58 extends beyond the highest point reached by the upper grid 91.

From the intermediate position illustrated in FIG. 2, the bed 21 is then folded into a second intermediate position (FIG. 3) in which the seat section 50 overlies the body section 40 and the cavity section 44 is generally upright. This movement is also controlled by the folding mechanism 55. The mattress seat section 78 remains in its collapsed condition.

Figure 4:
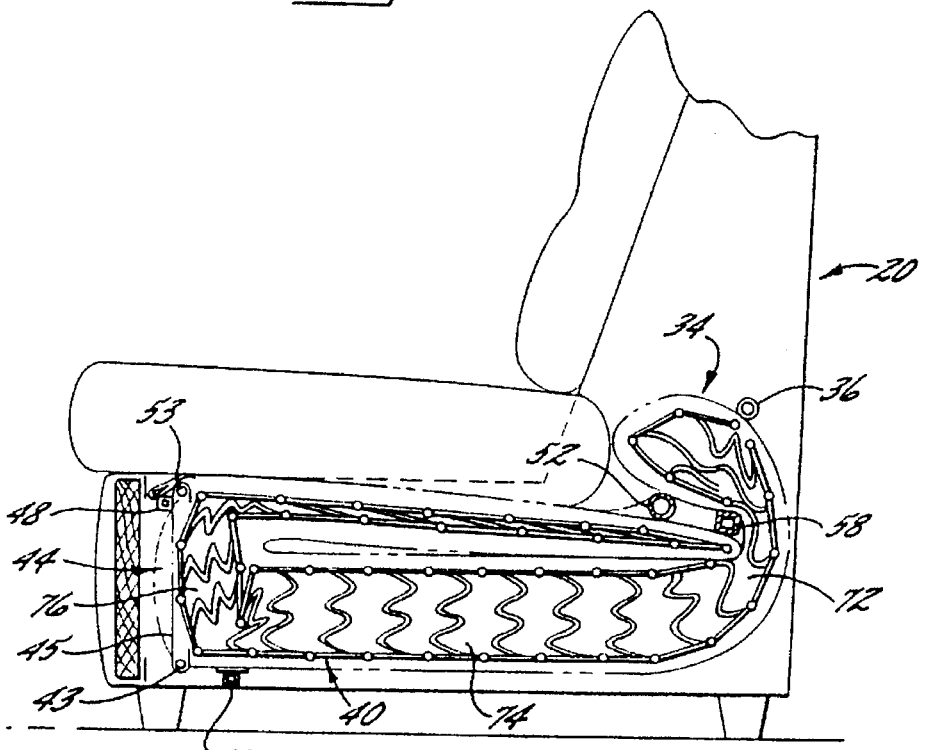
FIG. 4 is a fragmentary side view of the foldable bed of FIG. 1 showing the bed in its folded position.

Finally, the bed 21 is folded into its folded position (FIG. 4). This movement is controlled by the extension mechanism 30. In the folded position, the frame body section 40 is generally horizontally disposed, the frame seat section 50 is generally horizontally disposed and overlies the body section 40, the frame cavity section 44 is generally upright, and the frame head section 34 is generally upright. In this position, the bed 21 can be stored inside the cavity 24 of the sofa 20 when not in use.

Notably, the coil springs 80 of the mattress head section 72 are substantially compressed by the rear leg cross-member 58. By compressing this portion of the mattress head section 78, the rear leg cross-member 58 establishes additional space within which the row of collapsible springs 110 located at the foot of the bed 21 can reside in the closed position. This enables the mattress 70 to be somewhat longer than it could if a conventional rear leg 54 and bracing link 57 were employed in the illustrated embodiment. The row of springs 110 that comprise the foot end of the mattress 70 can originate from a point adjacent to the seat section cross member 52; if the cross-member 58 did not compress the head section 72, the rearmost row of springs 80 would have to be offset slightly toward the head end of the mattress 70, or a frame and mattress combination having additional sections would have to be employed. Preferably, the leg cross-member 58 is spaced apart from the seat section cross-member 52 in the folded position; typically this spacing is between about 2 and 8 inches.

FIGS. 12A and 12B show a spring 110 in an uncompressed and a compressed condition, respectively. As shown in FIG. 12B, the offset undulation 132 is sufficiently rearwardly offset that, under a compressive load, the offset undulation 132 does not contact the adjacent nonoffset undulation 135 (and thereby cease its movement, but instead is free to continue to move downwardly in a plane rearward of that occupied by the nonoffset undulation. Similarly, the offset undulation 133 is sufficiently offset from the adjacent nonoffset undulation 136 that, under a compressive load, the offset undulation 133 is free to pass in a plane forward of the nonoffset undulation 136. As a result, the distance over which the seat section 78 can be compressed is increased.

The increased compressibility of the spring 110 can be seen based on testing performed thereon described in Example 1 hereinbelow.

EXAMPLE 1

Five sinuous springs were .formed from wire having a diameter of 0.105 inches. The spring height and number of undulations of each spring are set forth in Table 1 below. Each spring had either 0 (spring E), 1 (springs A and B), or 2 (springs C and D) undulations that were laterally offset approximately 0.25 inches from the plane defined by the upper and lower runs of the spring and the remaining undulations.

TABLE 1

| Spring Sample | Height (in.) | No. of Undulations | Offset Undulations |
|---|---|---|---|
| Spring A | 4.25 | 5 | 1 |
| Spring B | 5.25 | 6 | 1 |
| Spring C | 5.25 | 6 | 2 |
| Spring D | 5.50 | 6 | 2 |
| Spring E | 5.25 | 6 | 0 |

Each spring was placed upright on the weighing surface of a scale. A ruler was placed behind the spring. The spring was then compressed in ½ inch increments, as measured by the ruler, and the force required for such compression was detected by the scale and recorded. Testing was continued for each spring until a pair of adjacent undulations contacted one another, which indicated that the spring had "bottomed out".

The results of the testing are recorded in Table 2.

TABLE 2

| Spring A | | Spring B | | Spring C | | Spring D | | Spring E | |
|---|---|---|---|---|---|---|---|---|---|
| D* | W* | D | W | D | W | D | W | D | W |
| 1/2" | 3 | 1/2" | 2 | 1/2" | 2 | 1/2" | 2 | 1/2" | 2 |
| 1" | 5 | 1" | 4 | 1" | 4 | 1" | 4 | 1" | 4 |
| 1 1/2" | 8 | 1 1/2" | 5 | 1 1/2" | 6 | 1 1/2" | 7 | 1 1/2" | 6 |
| 2" | 12 | 2" | 8 | 2" | 9 | 2" | 9 | | |
| | | 2 1/2" | 10 | 2 1/2" | 11 | 2 1/2" | 12 | | |
| | | | | 3" | 14 | 3" | 15 | | |
| | | | | 3 1/2" | 20 | 3 1/2" | 18 | | |
| | | | | | | 4" | 23 | | |

*D - Deflection
*W - Weight (lbs)

As the data in Table 2 indicate, the compressive depth attainable by the sinuous springs tested increased with the inclusion of offset undulations. Correspondingly, the amount of weight the springs were able to receive without bottoming out also increased significantly as offset undulations were added. Each of these general trends indicates that sinuous springs having offset undulations can provide superior comfort over conventional sinuous springs. Also, the increased compressibility also reduces the noise of the mattress, as adjacent undulations passing by one another are essentially noiseless. As a result, the sinuous springs having laterally offset undulations were able to achieve compressibility much like that of a Bonnell-type coil spring.

In summary, the sofa 20 and bed 21 have solved many of the problems that have plagued prior art foldable beds having collapsible springs. The springs 110 of the present invention do not over rotate in their upright position and have compressibility that far exceeds that of prior sinuous springs. Because sinuous springs can be used, the cost of the collapsible section of the bed is significantly decreased. The use of the grid wires 90 of the present invention enables simplified automatic interconnection of the grid wires and the wire springs, and the ability of the grid wires 90 to be used for both the upper and lower grids 91, 93 and to be disposed in either transverse direction further reduces the cost of the bed 21. The restricted use of collapsible springs 110 in the mattress seat section 78 alone further reduces cost over prior beds employing collapsible springs. The mattress 70 can be used with a frame 32 and folding mechanism 55 that is only slightly and quite easily modified from known mechanisms due to the configuration and positioning of the rear leg 54, as the leg 54 so configured and positioned compresses the mattress head section 72 sufficiently to enable the collapsible seat section 78 to be stored in the space created thereby. Finally, the reinforcement against lateral compression provided by the bowing strap 108 or other reinforcing means improves the performance of the mattress 70.

The foregoing embodiment is illustrative of the present invention, and is not to be construed as limiting thereof. The invention is defined by the following claims, with equivalents of the claims to be included therein.

That which is claimed is:

1. A mattress comprising:

a top face having a peripheral edge portion;

an inner core beneath said top face;

a border wire defining said top face peripheral edge portion; and a wire truss for reinforcing said top face peripheral edge portion and said inner core interconnected with said border wire, said wire truss having a width dimension and a depth dimension and being oriented so that said width dimension is substantially parallel with said mattress top face and said depth dimension is substantially orthogonal to said mattress top face, said wire truss being positioned adjacent said top face peripheral edge portion of said mattress and extending inwardly therefrom a short distance to define therewithin an uncovered area comprising a major portion of said top face, said wire truss being configured to have differential rigidity in the vertical and horizontal directions so that said wire truss is compliant to vertical compression of said top face peripheral edge portion toward said inner core, but said wire truss substantially resists horizontal compression of said top face peripheral edge portion.

2. The mattress of claim 1 further comprising a helical wire interconnecting said wire truss and said border wire.

3. The mattress of claim 1, wherein said mattress inner core comprises a section that is collapsible in the depth dimension.

4. A mattress comprising:

a top face having opposing head and foot ends and a peripheral edge portion;

an inner core beneath said top face;

a border wire defining said top face peripheral edge portion; and an elongate strap for reinforcing said top face peripheral edge portion and said inner core interconnected with said border wire, said strap being configured to have differential rigidity in the vertical and horizontal directions so that said reinforcing strap is compliant to vertical compression of said top face peripheral edge portion toward said inner core, but said reinforcing strap substantially resists horizontal compression of said top face peripheral edge portion, said strap having a width dimension and a depth dimension and being disposed adjacent at least one of said foot end and said head end of said mattress and oriented so that said width dimension is substantially parallel with said mattress top face and said depth dimension is substantially orthogonal to said mattress top face.

5. The mattress of claim 4, further comprising at least one clip attached to said border wire and said strap at predetermined locations along said top face peripheral edge portion to interconnect said strap with said border wire.

6. The mattress of claim 4, wherein said mattress inner core comprises a section that is collapsible in the depth dimension.

* * * * *